United States Patent [19]

Wallace, Jr.

[11] 4,347,690

[45] Sep. 7, 1982

[54] SKELETAL FRAMEWORK STRUCTURE AND JUNCTION FOR USE THEREIN

[76] Inventor: Brenton G. Wallace, Jr., 1529 Sweet Briar Rd., Gladwyne, Pa. 19035

[21] Appl. No.: 246,845

[22] Filed: Mar. 23, 1981

Related U.S. Application Data

[63] Continuation-in-part of Ser. No. 105,026, Dec. 19, 1979, abandoned.

[51] Int. Cl.[3] ..... E04B 1/32

[52] U.S. Cl. ..... 52/93; 52/86; 52/645; 135/3 R; 135/DIG. 1; 403/217

[58] Field of Search ..... 52/93, 86, 639, 641, 52/645, 655; 403/217; 135/3, 7.1 R, DIG. 1

[56] References Cited

U.S. PATENT DOCUMENTS

| | | | |
|---|---|---|---|
| 797,474 | 5/1905 | Walker . | |
| 1,622,746 | 3/1927 | Truemper . | |
| 2,871,997 | 2/1959 | Simpson et al. | 52/93 |
| 2,874,708 | 2/1959 | Daus . | |
| 2,989,154 | 6/1961 | Colby | 52/93 |
| 3,146,864 | 9/1964 | Nystrom et al. | 52/641 |
| 3,469,587 | 9/1969 | Folkes | 135/1 R |
| 3,530,623 | 9/1970 | Burton | 52/86 |
| 3,633,326 | 1/1972 | McKnight | 52/86 |
| 3,690,078 | 9/1972 | Maynard | 52/86 |
| 3,791,076 | 2/1974 | Gahler | 52/63 X |
| 3,798,851 | 3/1974 | Utahara | 52/86 |
| 3,826,270 | 7/1974 | Hentges | 135/4 R |
| 3,855,643 | 12/1974 | Sanford et al. | 135/3 R X |
| 3,863,659 | 2/1975 | Gillis | 135/4 R |
| 3,892,094 | 7/1975 | Spray | 52/86 X |
| 3,925,942 | 12/1975 | Hemmelsbach | 52/86 |
| 4,050,210 | 9/1977 | Gilb | 52/639 |
| 4,066,089 | 1/1978 | Rainwater | 135/4 R X |
| 4,091,584 | 5/1978 | Brown | 52/86 |
| 4,187,034 | 2/1980 | Dziewolski | 403/217 |

FOREIGN PATENT DOCUMENTS

| | | | |
|---|---|---|---|
| 23721 | 2/1981 | European Pat. Off. | 52/655 |
| 282965 | 5/1952 | Switzerland | 52/655 |

*Primary Examiner*—J. Karl Bell

*Attorney, Agent, or Firm*—Albert L. Free

[57] ABSTRACT

A skeletal framework structure employs a special junction for securing together the ends of the framework members, the ends of one pair of which members have longitudinal axes lying in a common plane while the axes of others of the members extend at angles to that plane. The framework members having axes lying in the same plane may be parts of straight tubular arch members in the framework, while the framework members extending at an angle to that plane may constitute spacer members, or purlins, extending perpendicular to the plane of the arch members, or may constitute diagonal bracing members extending at other angles to the plane of the arch members. In the junction, a first flat plate member extends parallel to the plane of the axes of the arch members and bears against and bridges the adjacent ends of said arch members, while a second similar plate member parallel to the first plate member bears against the opposite sides of the same arch members. Two angle members are preferably also employed, one on each of the opposite outer sides of the two plate members, and each having a first flange portion which extends over and against its associated plate member. The angle members, the plate members and the arch members are bolted and clamped together by four bolt-and-nut combinations, two through each of the arch members. The second flange portions of the two angle members are bolted to the ends of the purlins, and the ends of the diagonal brace members may be secured directly to the plate members by two of the four bolts. The two plate members and the two angle members are preferably substantially identical to each other, and may be used interchangeably in other junctions in the framework assembly. The arch members and purlins are hollow tubes of uniform, preferably rectangular, cross-section.

12 Claims, 11 Drawing Figures

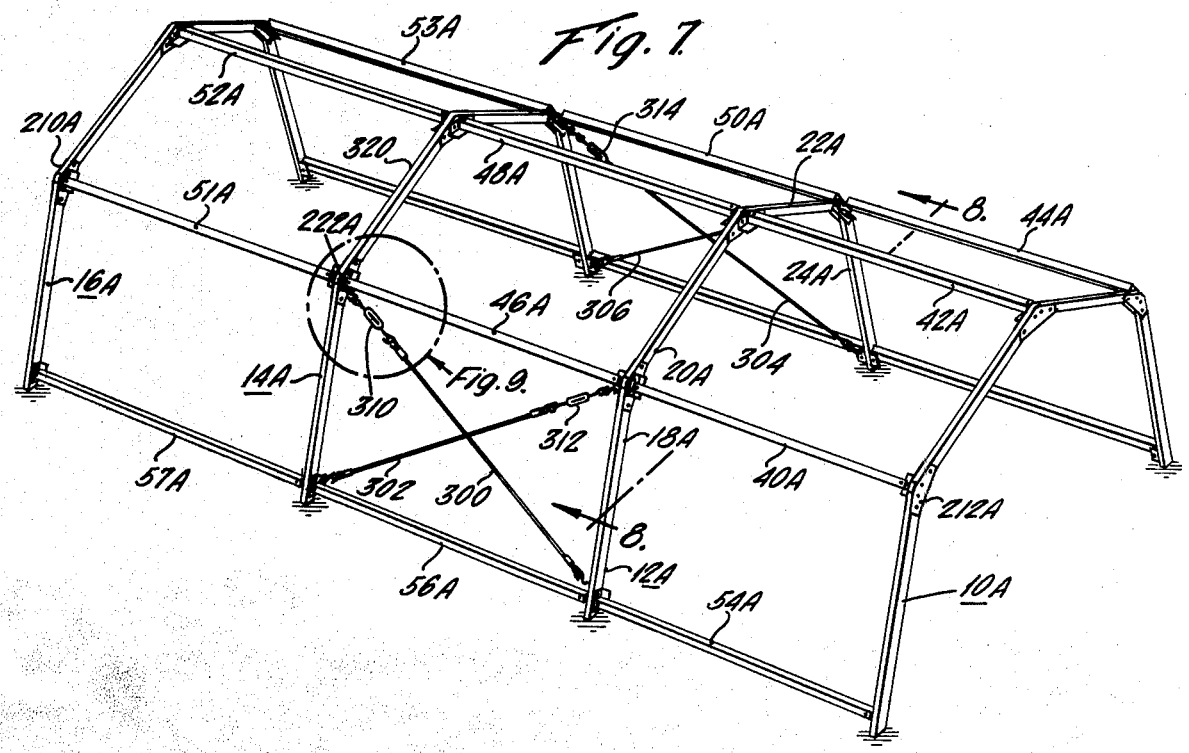
Fig. 7
53A
52A
210A
314
50A
22A
320
48A
51A
222A
8.
44A
16A
24A
46A
306
42A
14A
310
Fig. 9.
20A
304
312
18A
57A
302
300
40A
212A
8.
12A
56A
54A
10A
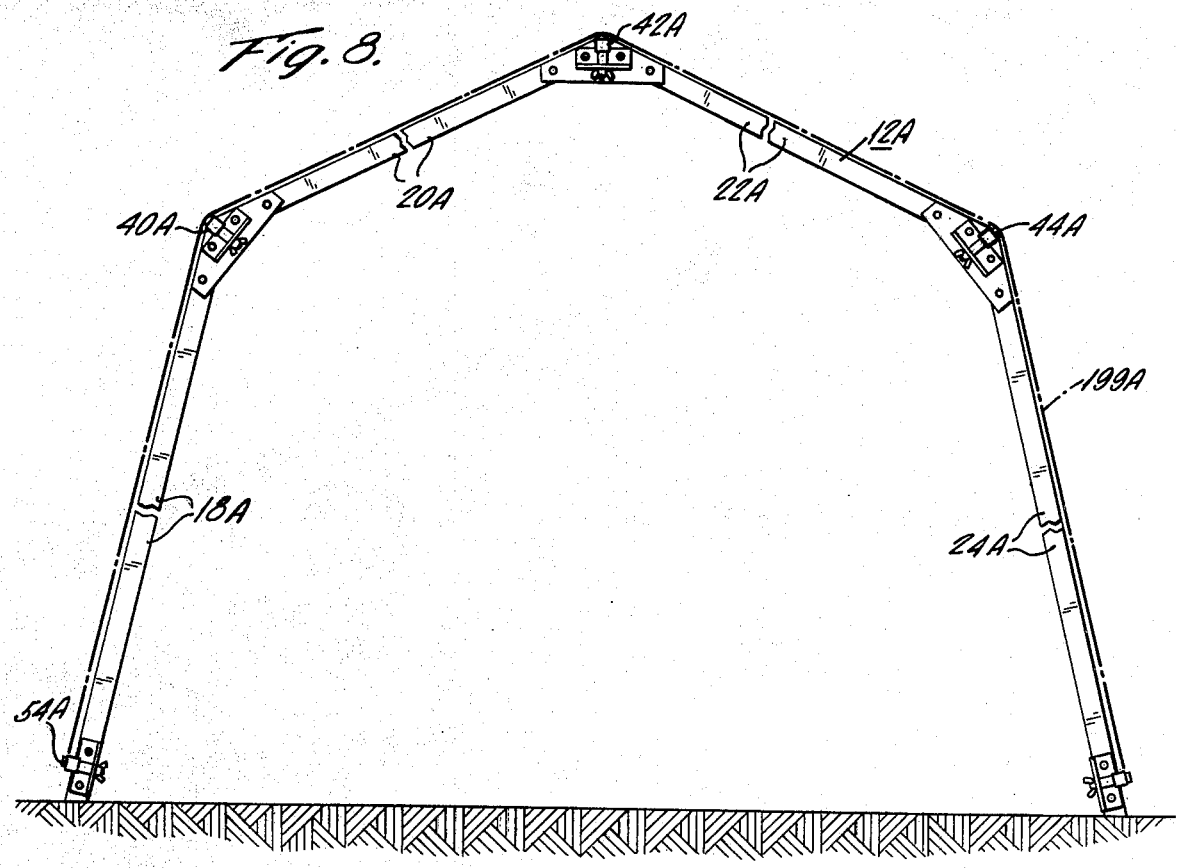
Fig. 8.
42A
12A
20A
22A
40A
44A
199A
18A
24A
54A

SKELETAL FRAMEWORK STRUCTURE AND JUNCTION FOR USE THEREIN

CROSS REFERENCE

The present application is a continuation-in-part of application Ser. No. 105,026, filed Dec. 19, 1979 now abandoned.

BACKGROUND OF THE INVENTION

There are many applications in which it is desirable to bolt together securely the ends of skeletal framework members extending in various directions. In one application with respect to which the invention will be particularly described a domed modular skeletal framework of tubular members may be assembled to form a space enclosure to which a covering such as flexible fabric, plastic sheeting, or rigid panels may be secured, for example to form an automobile garage, a utility building, a swimming pool enclosure or any of various other such enclosures. The skeletal framework may consist of a plurality of straight-segmented arches arranged in spaced, parallel vertical planes, with each such arch connected to one or more others by a series of spacer members, or purlins, which are parallel to each other and perpendicular to the planes of the arches, as well as by a series of diagonal braces extending in other directions. At some positions in the framework it may only be required to join a pair of arch-members to each other and to one other arch-connecting member, while at other points it may be necessary also to join one or more additional arch-connecting members extending at an angle to the plane of the arches.

There are a variety of junction devices which might be used to join together the ends of such tubular members. However, many of these are relatively complex and expensive to manufacture and/or difficult to assemble or disassemble, and in many cases they require either many different kinds of parts for use at different locations in the framework, or require an elaborate multipurpose junction whose cost and complexity is wasted when only two or possibly three tube ends are to be joined, rather than four or more.

Accordingly, it is an object of my invention to provide a new and useful skeletal framework using a novel junction for securing together the adjacent ends of framework members.

Another object is to provide such junction which is capable of securing together the adjacent ends not only of a pair of coplanar framework members, but also to secure one or more additional framework members which extend at an angle to the plane of the coplanar pair of framework members.

A further object is to provide such a junction which uses only very simple, easily assembled parts which are simple and inexpensive to manufacture, and which parts may be used interchangeably at a large number of junctions in the assembly and assembled and disassembled using only a simple wrench.

SUMMARY OF THE INVENTION

In accordance with the invention, these and other objects are achieved by the provision of a skeletal framework structure adapted to support an appropriate covering of fabric or the like to form a space enclosure, comprising a plurality of parallel vertically-disposed arches horizontally spaced from each other, each of said arches comprising a plurality of tubular arch members adjacent pairs of which are joined to each other at their adjacent ends by junctions, said adjacent ends of each of said pairs having longitudinal axes extending in a common plane and at an angle to each other, said arches being interconnected by a plurality of tubular arch-connecting members connected to said junctions and extending at an angle to said plane, at least some of said junctions comprising: a first plate member a first surface of which is generally parallel to said common plane of the adjacent ends of the associated pair of said tubular arch members, said first surface of said first plate member bearing against one side of each of said associated tubular arch members and bridging their adjacent ends; a second plate member a first surface of which is generally parallel to said common plane of said adjacent ends of said associated pair of tubular arch members; said first surface of said second plate member bearing against the opposite side of said associated tubular arch members and bridging their associated ends; at least four bolt members, one pair of which extend through both of said plate members and through one of said pair of associated tubular arch members and another pair of which extend through both of said plate members and the other of said pair of associated tubular arch members; nut means for each of said bolt members for permitting tightening of said bolt members to draw said plate members toward each other and to clamp said associated tubular arch members between said plate members; a first angle member having a first flange portion extending over and against a surface of said first plate member and having a second flange portion substantially at right angles to said first flange portion, at least two of said bolt means extending through said first flange portion for securing said first angle member in position; and means for securing one end of one of said arch-connecting tubular members to said second flange portion.

Preferably the junction also comprises one or more of the following further features. The bolt means of each pair are spaced from each other along one of the arch members, and the angle member is secured by those two of the four bolt means nearest the adjacent ends of the arch members. At least one of the arch-connecting members secured to the angle members preferably extends at right angles to the plane of the arch members, and at least one of the diagonal arch-connecting members is preferably attached to one of the plate members by one of said bolts which does not pass through an angle member. In a preferred form of the invention a similar second angle member is similarly secured to the opposite side of the second plate member, and used to secure another purlin on the opposite side of the junction.

Preferably also, at least the arch members and preferably the arch-connecting purlins are tubes of uniform cross-section, and in a particularly advantageous embodiment these members are of rectangular cross-section and disposed so that their flat side surfaces lie flat against the adjacent flat surfaces of the junction.

The resultant structure is strong and rigid, is easily assembled and disassembled, and uses parts which are inexpensive to make, ship and store.

BRIEF DESCRIPTION OF FIGURES

These and other objects and features of the invention will be more readily understood from a consideration of the following description, taken with the accompanying drawings, in which:

FIG. 7 is a perspective view of another form of skeletal structure embodying the invention in a presently preferred form;

FIG. 8 is a sectional view taken along lines 8—8 of FIG. 7;

DETAILED DESCRIPTION OF SPECIFIC EMBODIMENTS

Figure 1:
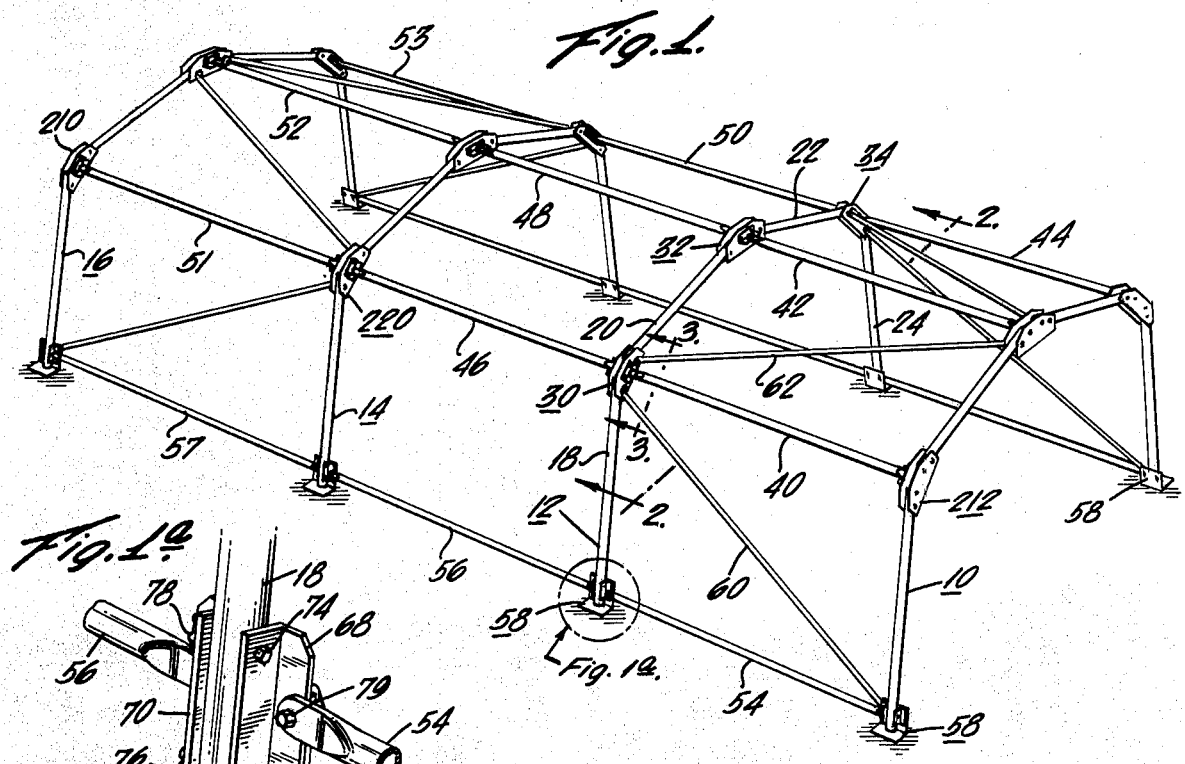
FIG. 1 is a perspective view of a skeletal framework structure embodying the invention.
Figure 2:
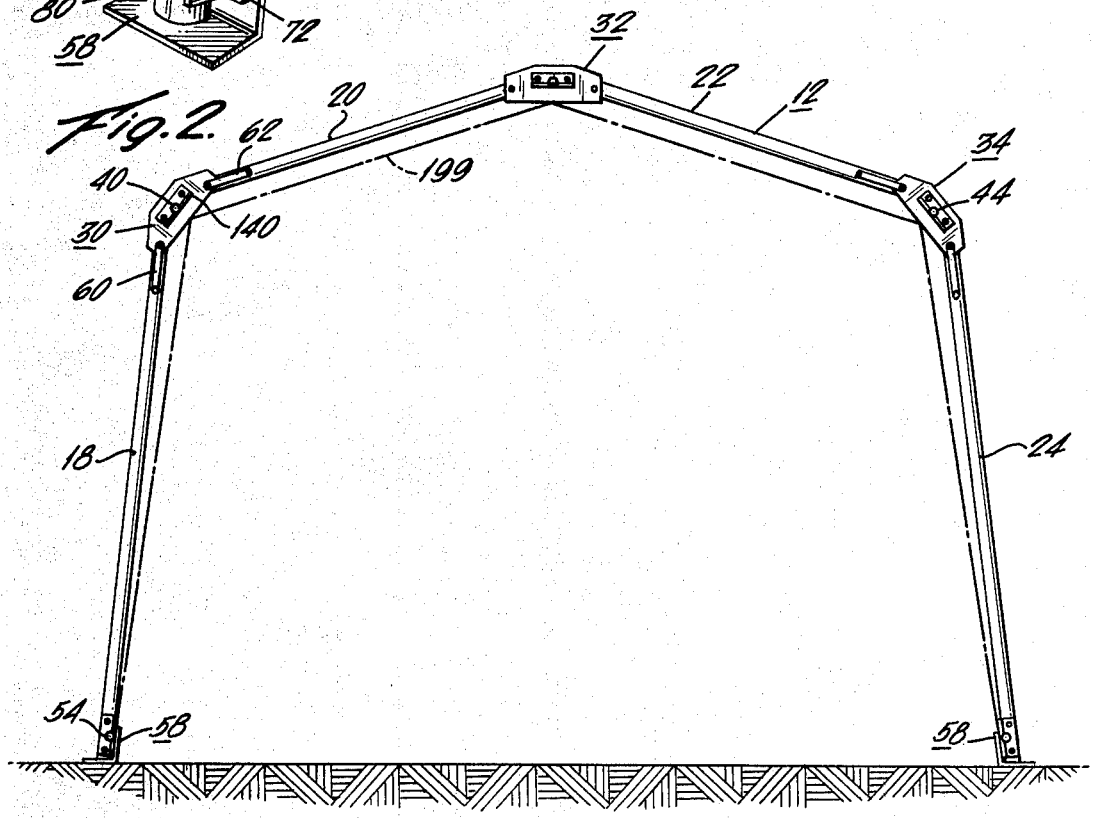
FIG. 2 is a vertical section taken along lines 2—2 of FIG. 1.

Referring now to the embodiment of the invention illustrated in the drawings by way of example only, FIGS. 1 and 2 show a skeletal framework structure adapted to be provided with a covering to form a space enclosure beneath it. In this example, it comprises four arches, 10, 12, 14 and 16 disposed vertically, and spaced horizontally from each other. Each arch such as 12 is made up of four tubular arch members 18, 2, 22 and 24 positioned at suitable angles with respect to each other to form the desired shape of arch and joined by junctions such as 30, 32 and 34. While different numbers of arch members and different angles between them may be used in different applications, in this specific example it is assumed that arch member 18 makes an angle of about 115° with arch member 20, arch member 22 makes the same angle of about 115° with arch member 24, and arch members 20 and 22 make an angle of about 145° with each other at the apex of the arch. In this example the arch members may be hollow tubes of steel, although aluminum is often beneficial from the viewpoint of lightness of weight.

The several arches are interconnected and spaced from each other by tubular arch-connecting members such as 40, 42, 44, 46, 48, 50, 51, 52 and 53 extending horizontally, i.e. at right angles to the vertical planes of the arches, these arch-connecting members being designated as purlins. The arches are also interconnected by base purlins such as 54, 56 and 57 extending along and near the ground and secured by mounting foot structures such as 58. In this example, the arches are also interconnected by diagonal arch-connecting members such as 60 and 62 and others, which serve as braces adding rigidity to the frame structure.

More particularly, the base purlins, such as 54 and 56, are secured to the lower ends of the corresponding upright arch members to which they are attached by foot structures such as 58, comprising a pair of angle members 68 and 70 which may be identical to each other, mounted near the lower end of arch member 18 and on opposite sides thereof by means of bolts 72 and 74 and corresponding wing nuts 76 and 78. Thus one flange portion of each of the latter angle members is secured to the upright arch member 18, while the other flange portion of each such angle member is connected to an end of one of the base purlins 54, 56, by bolts such as 79. Another large angle member 80 serves as a foot or spade to prevent sinking of the arch members into the ground, and is appropriately secured by bolts 79 to the latter flange portions of both of the angle members 68 and 70. Angle member 80 has a horizontal flange extending beneath the lower end of arch member 18, for resting on the surface of the ground as shown.

Adjacent ends of the arch members are connected to each other by junctions, for exmple 30, 32, 34 which junctions serve also to connect and secure the adjacent ends of any purlins or diagonal arch-connecting members terminating at that junction. For example, junction 30 rigidly secures together the ends of arch members 18 and 20, an also secures the adjacent ends of purlins 40 and 46 and diagonal braces 60 and 62. The strength of the entire structure then depends upon the strength of each such junction, and the ease of erecting and disassembling the structure depends upon the simplicity and ease of manipulation of the parts of the junction during such operations. It will also be appreciated that it is advantageous to use parts in such junctions which, as much as practical, are interchangeable among the several junctions.

Figure 3:
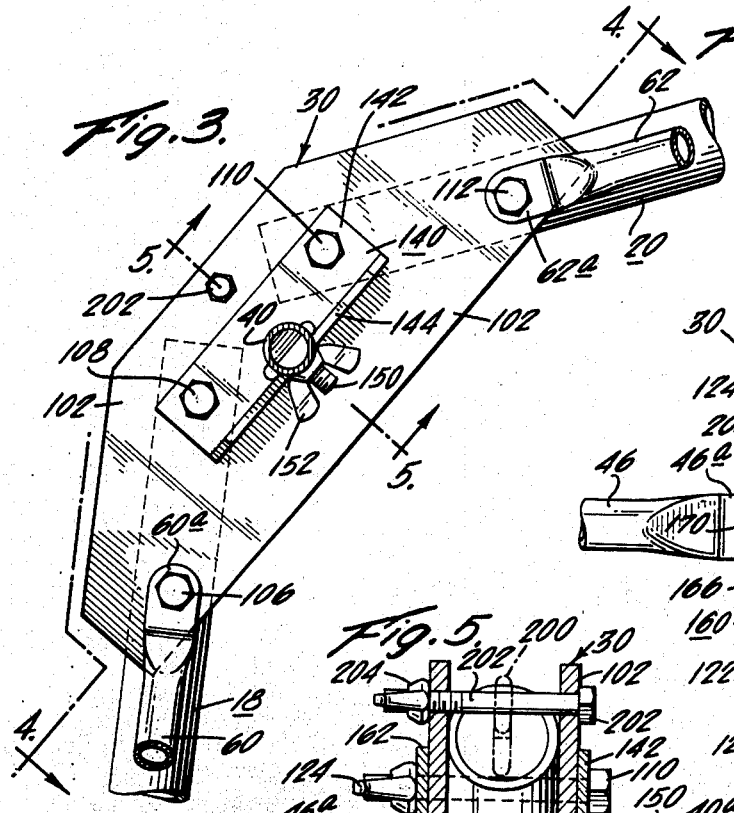
FIG. 3 is an enlarged side view of one of the junctions of the invention, as viewed along lines 3—3 of FIG. 1.
Figure 4:
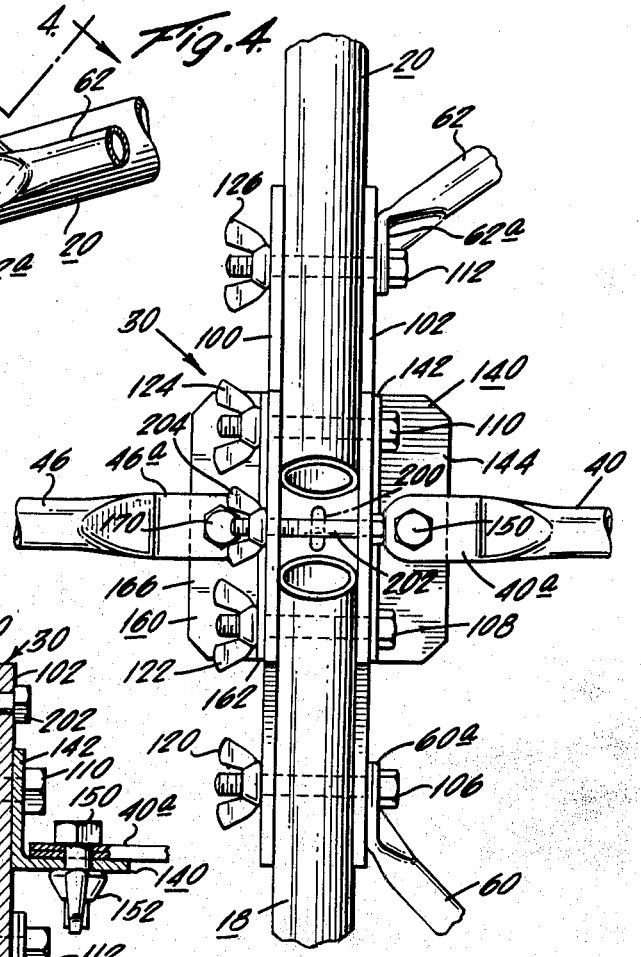
FIG. 4 is a plan view taken along the direction 4—4 in FIG. 3.
Figure 5:
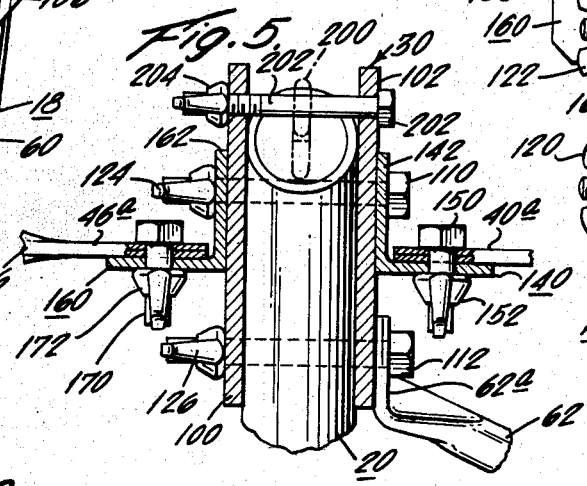
FIG. 5 is a sectional view taken along lines 5—5 of FIG. 3.

Referring now particularly to FIGS. 3 to 5 showing a preferred embodiment of the junction 30, the junction comprises a pair of plate members 100 and 102 which are disposed vertically, i.e. parallel to the plane of the longitudinal axes of the ends of the arch members 18 and 20. The plate members bear against opposite sides of the arch members 18 and 20, and bridge the gap between their ends. The end portions of arch members 18 and 20 have respective longitudinal axes lying in a common vertical plane, and through which bolts 106, 108, 110 and 112 extend. The heads of the bolts lie on the outer side of plate 102, and the bolts extend through corresponding openings in plate 102, then through the corresponding holes in the arch members and in plate 100. Appropriate wing nuts 120, 122, 124 and 126 are provided on the free ends of bolts 106, 108, 110 and 112 respectively, so that by tightening the wing nuts the plate members 100 and 102 clamp the ends of the arch members 18 and 20 between them. In this manner arch members 18 and 20 are securely fixed against relative translational and rotational motion with respect to each other.

Also employed is a first angle member 140 having a first flange portion 142 extending over and against the outer surface of plate member 102, and having a second flange portion 144 substantially at right angles to first flange portion 142. First flange portion 142 is provided with a pair of bolt holes through which bolts 108 and 110 extend, thereby clamping the upright first flange portion 142 of angle member 140 to the outer surface of plate member 102. Angle member 140 not only provides additional strengthening for the junction, but also provides, on second flanged portion 144, a flat surface on which the flattened end 40*a* of purlin 40 is positioned and secured by bolt 150 and wing nut 152.

In junction 30, a second angle member 160 is employed, having a first flange portion 162 extending over and against the exterior side of plate member 100, and having a second flange portion 166 extending at right angles to said first flange portion. Second angle member 160 is secured to plate member 100 by means of a pair of holes in first flange portion 162 through which bolts 108 and 110 extend, and against which the wing nuts 122 and 124 bear when they are tightened. Angle member 160 not only provides still further strengthening of the junction 30, but also provides a flat surface on its second flange portion 166 for receiving the flattened end 46*a* of purlin 46, which is secured thereto by means of an appropriate bolt 170 and wing nut 172.

The flattened ends 60*a* and 62*a* of diagonal arch-connecting members 60 and 62 are located flush against the outer surface of plate member 102, and provided with holes through which bolts 106 and 112 extend, thereby rigidly securing the ends of the diagonal supports 60 and 62 to the junction.

In the case in which the framework is utilized to support an interior covering such as is indicated at 199 of FIG. 2, a covering-support S-link 200 may be hung from a horizontal bolt 202 which extends through and between the plate members and is secured by a wing nut 204.

Figure 6:
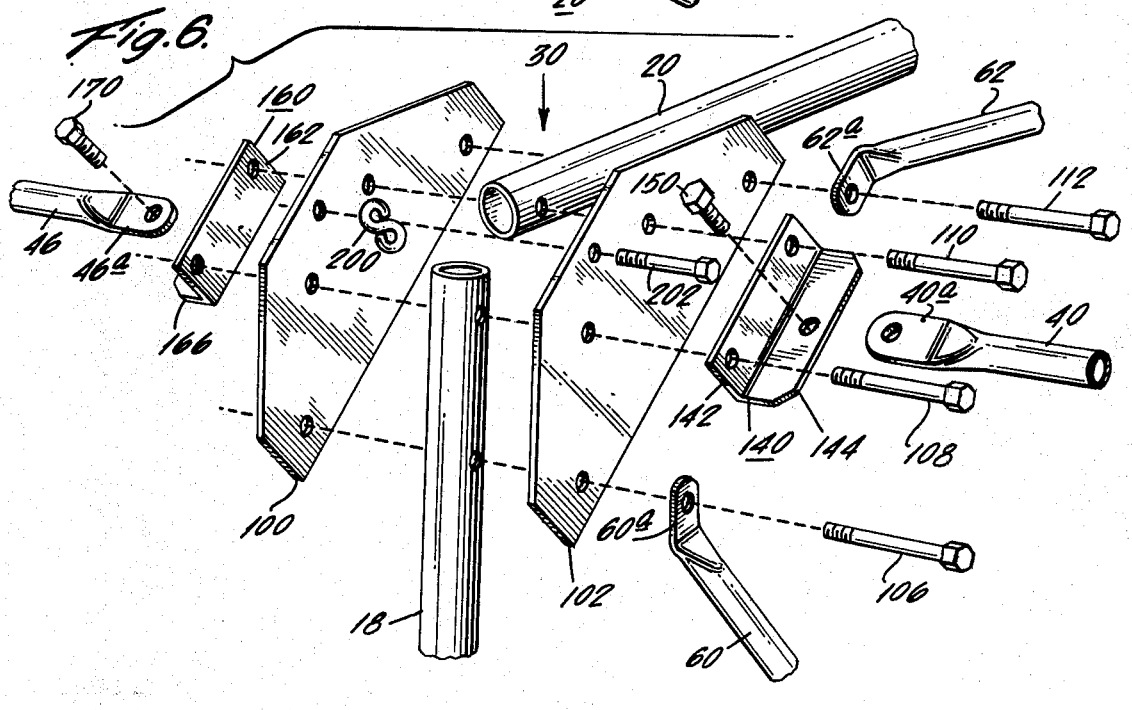
FIG. 6 is an exploded perspective area of the junction of FIGS. 3 to 5.

The exploded view of FIG. 6 illustrates clearly the components of junction 30 and the manner of its convenient assembly, with the exception of the wing nuts whose application to the ends of their corresponding bolts will be apparent.

All of the junctions other than 30 include the pair of opposed plate members and at least one of the angle members. However, as an example, while junction 34 is identical in construction and connection to junction 30, junction 32 differs in that connections to diagonal arch-connecting members are not required and are omitted; further, at junction 32 the mutual angle formed by the longitudinal axes of arch members 20 and 22 differs from that formed by arch members 18 and 20, and there is a corresponding difference in the positions of the four principal plate-clamping bolts. Junctions such as 210 and 212 at the opposite longitudinal extremes of the structure each have a purlin connected to only one side thereof, and in such case the opposite angle member may also be omitted. Junction 220 may be identical with junction 30, except that the diagonal arch-connecting members extend from the opposite side of the junction.

It has been found that a skeletal framework structure such as that of FIG. 1 utilizing junctions according to the invention is not only very strong and rigid, but is easily assembled and disassembled as described previously. It also lends itself to modular construction, in that more or fewer arch members may readily be incorporated using the same techniques. Further, all of the parts employed in the junction may be completely interchangeable among junctions, with the exception that the positions of the main clamping holes through the junction depends upon the angle made by the arch members which they join, and the angles of the bevels on the top edges of the plate members are preferably different so as to parallel the arch members which they join. In the embodiment shown, there would need be only two such different types of plate members for the entire system. Further, the corresponding arch members in the different arches can be identical with each other, all purlins may be identical to each other, there are only two types of diagonal arch-connecting members differing only in length, and there is no difference in "handedness" of the arch members and arch-connecting members, i.e. it does not matter which end of any such member is secured to a given junction.

Another presently-preferred embodiment of the invention is illustrated in FIGS. 7 to 10, wherein certain parts corresponding to, but not necessarily identical with, corresponding parts of FIGS. 1 to 6 are indicated by corresponding numerals with the suffix A.

Figure 1A:
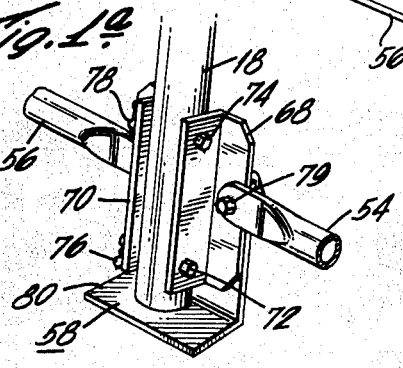
FIG. 1*a* is a fragmentary enlarged perspective view of the foot structure within the broken-line circle in FIG. 1.
Figures 9, 10:
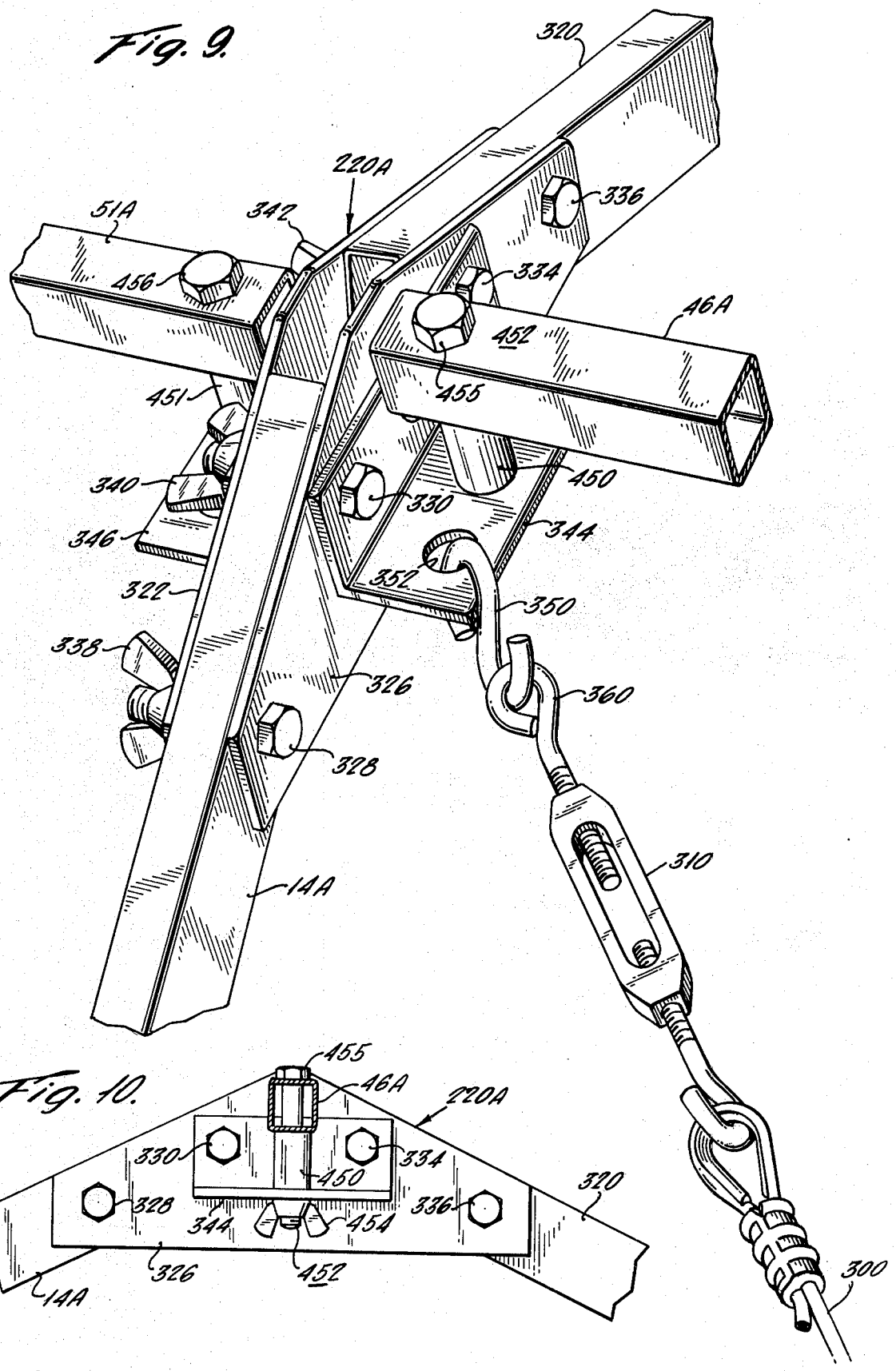
FIG. 9 is an enlarged fragmentary perspective view of a portion of the structure of FIG. 7, showing a typical junction with a diagonal cable support attached thereto.
FIG. 10 is an enlarged fragmentary elevational view of the junction of FIG. 9, with the diagonal cable support removed.

This embodiment differs from the previously described embodiment primarily in that: each of the horizontal purlins or arch-connecting members such as 46A, 48A etc. is a hollow tube of constant rectangular cross-section from end-to-end, e.g. $1\frac{1}{4}''$ square, rather than a round tube; each of the arch members such as 18A, 20A, etc. is a hollow rectangular tube of constant cross-section, e.g. $1'' \times 2''$, rather than a round tube; all diagonal tubes such as 60,62 in FIG. 1 are eliminated, and instead crossed pairs of plastic-coated airplane cables such as 300,302 and 304,306 each tensioned by corresponding turnbuckles such as 310, 312 and 314, are used at the center of both sides of the structure as shown, secured to corresponding angle members of the junctions by appropriate hooks and eyes as will be described with particular reference to FIG. 9; the structure is designed to use an external cover 199A rather than an internal covering, the feet 58 of FIG. 1*a* are not used, and the detailed form of the junctions is different, as will now be described.

Referring particularly to FIGS. 9 and 10 showing a typical junction such as 220A, the arch members 14A and 320 are rectangular hollow tubes having their broader faces disposed vertically and located between and against the broad surfaces of plates 322 and 326, wherein they are clamped by means of the four bolts 328, 330, 334 and 336, and by four corresponding wing nuts such as 338, 340 and 342. The angle members 344 and 346 are also clamped in position by these wing nuts and bolts as in the previous embodiment. Also shown is an S link 350 secured at one end in opening 352 in the horizontal flange of angle member 344, and at its other end in the eye 360 of turnbuckle 310, which serves to tension diagonal bracing cable 300.

FIGS. 9 and 10 also show how each of the square purlins such as 46A and 51A are mounted. For example, centrally-bored stand-off cylinders 450 and 451 are mounted upright on the horizontal flanges of angle members 344 and 346 by means of vertical bolts such as 452 and corresponding wing nuts such as 454, one flat face of square purlins 46A and 51A resting flat against the top of stand-off cylinders 450 and 451 beneath the heads 455 and 456 of the corresponding bolts by which they are tightly clamped in position.

In this preferred embodiment, all junction plates, angle members, bolts, wing nuts, purlins and arch members may be the same for each bay of the structure and each purlin and each arch member is a rectangular tube of constant cross-section, so that the parts are inexpensive to make and easy to assemble due to their simplicity, shape, and high degree of interchangeability. In addition, the rectangular cross-sections of the purlins and arch members make accurate drilling of the requisite holes therein much easier, and provide a more rigid and torque-resistant structure due to the clamping of the flat surfaces of the purlins and arch members to corresponding flat surfaces in the several junctions. Further, it is not necessary to employ a special fabrication step to flatten ends of the purlins or arch-members as in the previous embodiment, and the resultant structure is also considerably stronger. Further, the erection procedure is greatly facilitated by the use of the cables for diagonal bracing, since they are connected without requiring temporary removal and replacement of the outermost bolts of the junction.

The lengths and mutual angles formed by the arch members are illustrated in the Figures are by way of example only; it will be understood that other lengths, numbers, and mutual angles of arch members, and other numbers and arrangements of purlins and diagonal supports may be employed in other versions of the skeletal framework structure.

Thus while the invention has been described with particular reference to specific embodiments thereof in the interest of complete definiteness, it will be understood that it may be embodied in a variety of forms diverse from those specifically shown and described, without departing from the spirit and scope of the invention as defined by the appended claims.

What is claimed is:

1. In a skeletal framework structure adapted to be provided with a covering or lining to form a space enclosure, comprising a plurality of parallel vertically disposed arches horizontally spaced from each other, each of said arches comprising a plurality of straight-segment tubular arch members adjacent pairs of which are joined to each other at their adjacent ends by junctions, and said adjacent ends of each of said pairs having longitudinal axes extending in a common plane and at an angle to each other, said arches being interconnected by a plurality of tubular straight-segment arch-connecting members connected to said junctions and extending at an angle to said plane, the improvement wherein at least some of said junctions comprise:

a first plate member a first surface of which is generally parallel to said common plane of the adjacent ends of the associated pair of said tubular arch members, said first surface of said first plate member bearing against one side of each of said associated tubular arch members and bridging their adjacent ends;

a second plate member a first surface of which is generally parallel to said common plane of said adjacent ends of said associated pair of tubular arch members, said first surface of said second plate member bearing against the opposite side of said associated tubular arch members and bridging their associated ends;

at least four bolt members, one pair of which extend through both of said plate members and through one of said pair of associated tubular arch members and another pair of which extend through both of said plate members and the other of said pair of associated tubular arch members;

nut means for each of said bolt members for permitting tightening of said bolt members to draw said plate members toward each other and to clamp said associated tubular arch members between said plate members;

a first angle member having a first flange portion extending over and against a surface of said first plate member and having a second flange portion substantially at right angles to said first flange portion, at least two of said bolt means extending through said first flange portion for securing said first angle member in position; and means for securing one end of one of said arch-connecting tubular members to said second flange portion.

2. The structure of claim 1, wherein said one pair of said bolt means are spaced from each other along said one of said tubular arch members, and said other pair of bolt means are spaced from each other along said other of said tubular arch members.

3. The structure of claim 1, wherein said at least two bolt means for securing said angle member comprise those two of said four bolt means which are nearest said adjacent ends of said associated tubular arch members.

4. The structure of claim 1, wherein said arch-connecting member secured to said second flange member extends substantially at right angles to said plane.

5. The structure of claim 1, wherein an end of at least one of said tubular arch-connecting members is secured to one of said plate members by one of said bolt means.

6. The structure of claim 1, comprising a second angle member substantially identical to said first angle member, having a first flange portion extending over and against a surface of said second plate member and secured thereto by at least two of said four bolt means.

7. The structure of claim 6, wherein at least one of said arch-connecting tubular members extends at right angles to said plane and is secured to said second flange portion of said second angle member.

8. The structure of claim 7, wherein one of said arch-connecting tubular members extends at other than right angles to said plane and is secured by one of said bolt means other than those extending through said angle members.

9. The structure of claim 1, wherein each of said adjacent pairs of tubular arch members and at least one of said tubular arch-connecting members interconnected by a junction are tubes each having a uniform rectanglar cross-section from one end to the other thereof.

10. The structure of claim 9, wherein said first and second plate members bear against opposite flat side surfaces of said rectangular tubes constituting said arch members, and wherein one flat side surface of said tube constituting said at least one arch-connecting member is positioned flat against a flat surface of said junction.

11. The structure of claim 10, wherein said junction comprises a stand-off member having first and second flat end surfaces, one of said end surfaces being mounted flat against said second flange portion and said one arch-connecting member being mounted flat against said second end surface of said stand-off member.

12. The structure of claim 1, wherein all of said plate members are identical with each other and all of said angle members are identical with each other.

* * * * *